US007248233B2

(12) United States Patent
Moreau

(10) Patent No.: US 7,248,233 B2
(45) Date of Patent: Jul. 24, 2007

(54) CONTROL CIRCUIT AND PROCESS FOR A CATHODE RAY TUBE DISPLAY CONTROL APPARATUS

(75) Inventor: Jean-Michel Moreau, Grenoble (FR)

(73) Assignee: STMicroelectronics S.A., Montrouge (FR)

( * ) Notice: Subject to any disclaimer, the term of this patent is extended or adjusted under 35 U.S.C. 154(b) by 626 days.

(21) Appl. No.: 10/701,151

(22) Filed: Nov. 4, 2003

(65) Prior Publication Data

US 2004/0130275 A1 Jul. 8, 2004

(30) Foreign Application Priority Data

Jul. 1, 1999 (EP) ..... 03300045

(51) Int. Cl.
*G09G 1/06* (2006.01)

(52) U.S. Cl. ..... 345/11; 345/12; 345/13

(58) Field of Classification Search ..... 345/10, 345/11, 12, 13, 14, 29
See application file for complete search history.

(56) References Cited

U.S. PATENT DOCUMENTS 5,717,296 A * 2/1998 Onozawa et al. ..... 315/371
6,573,669 B1 * 6/2003 Chiu ..... 315/388

* cited by examiner

*Primary Examiner*—Richard Hjerpe
*Assistant Examiner*—Jean Lesperance
(74) *Attorney, Agent, or Firm*—Lisa K. Jorgenson; James H. Morris; Wolf, Greenfield & Sacks, P.C.

(57) ABSTRACT

A control circuit of a power supply delivering a supply current to an inductor connected in series with the horizontal deflection yoke of a cathode ray tube display, the inductor being the primary coil of a transformer operatively connected for delivering a rectified low-pass filtered biasing voltage to the anode of the display, the low-pass filtering having a first time constant corresponding to the duration of a plurality of pictures, the control circuit having feedback circuitry for generating a monitoring voltage substantially proportional to the biasing voltage and for controlling the supply current to keep the monitoring voltage equal to a reference voltage; and feedforward circuitry for measuring the cathode current and for adding to the monitoring voltage a compensation voltage corresponding to the cathode current, low-pass filtered with a second time constant corresponding to the duration of a small number of lines and high-pass filtered with the first time constant.

22 Claims, 2 Drawing Sheets

CONTROL CIRCUIT AND PROCESS FOR A CATHODE RAY TUBE DISPLAY CONTROL APPARATUS

BACKGROUND OF THE INVENTION

1. Field of the Invention

This invention relates generally to a control apparatus of a low-cost multi-frequency cathode ray tube (CRT) display such as a computer monitor and, more specifically, to a control circuit of the high voltage power supply of the CRT.

2. State of the Art

The tube of a CRT display typically comprises a screen biased at the anode voltage of the tube. The cathode of the tube is provided for emitting a video-modulated beam of electrons toward the screen. Horizontal and vertical deflection yokes deflect the electron beam so that it sweeps a predetermined area of the screen. The video modulation of the intensity of the electron beam during the sweeping of the screen enables displaying a picture on the screen.

FIG. 1 schematically represents a known control apparatus of a low-cost multi-frequency monochrome CRT display 2 having an anode 4 and a cathode 6. Such a control apparatus is for example described in the "Nouveau guide de télévision en couleurs", issued by the Syndicat de Constructeurs d'Appareils de Radio et de Télévision (SCART), pages 197–202, concerning the horizontal sweeping yoke, and in the application notes of the circuits having the reference numbers 9112 or 9112A from STMicroelectronics concerning the power supply of the yoke.

The horizontal deflection yoke 8 of the display is connected to a yoke control unit comprising a diode 12, a switch 14 and capacitors 16 and 18. The cathode of diode 12 is connected to a first end of the yoke 8. The anode of diode 12 is connected to a ground or common reference voltage. Switch 14 and capacitor 16 are connected in parallel with the diode 12. The second end of yoke 8 is connected to the ground through capacitor 18. The first end of yoke 8 is connected through an inductor 20 to a power supply 21. Power supply 21 comprises a controlled current source 22 delivering an average supply current Is. A capacitor 23 is connected in parallel with current source 22. Current source 22 is a known step up current mode source.

Inductor 20 forms the primary coil of a low/high transformer 24 of an anode biasing unit. A high turn count secondary coil 28 of transformer 24 has a first end connected to the ground and a second end connected to the anode of a diode 30. The cathode of diode 30 is connected through a low pass filter 32 to the anode 4 of the display. Low pass filter 32 is illustrated as comprising a resistor 34, corresponding to the resistance of the coil 28, connected in series with diode 30, and a capacitor 36 connected between the anode 4 and the ground.

A sensing coil 37 of transformer 24, comprising a low number of turns compared to coil 28, has one end connected to the ground and one end connected to a control circuit 38. The control circuit 38 comprises a feedback block 39 and may comprise other blocks that are not illustrated. Feedback block 39 comprises a rectifying diode 40, a filtering capacitor 42, a voltage divider and an amplifier. The anode of diode 40 is connected to sensing coil 37. The cathode of diode 40 is connected to the ground through capacitor 42. The voltage divider is comprised of two resistors 44, 46 connected in series between the cathode of diode 40 and the ground. The amplifier comprises an operational amplifier 48 having its inverting input connected to the node between resistors 44 and 46 and its non-inverting input connected to a reference voltage Vref. A capacitor 49 is connected between the inverting input and the output of amplifier 48 in a known manner for stability purposes. The output of amplifier 48 controls the current source 22. While most often the current source 22 works in a switched mode, the important point is that the average of the current it supplies is controlled by the output voltage of amplifier 48.

For sweeping a line of the screen, switch 14 is alternatively opened and closed to make the current in yoke 8 increase at a predetermined speed from a predetermined negative maxima to a predetermined positive maxima, then to make the current in yoke 8 return fast to the predetermined negative maxima (current flyback). This causes the electron beam to sweep a line of the screen and then return fast to an appropriate position for sweeping the next line. The vertical deflection yoke (not illustrated) is controlled to move the beam vertically to the next line during flyback.

A voltage peak appears across inductor 20 during flyback. A corresponding high voltage peak appears across coil 28, which is rectified through diode 30 and smoothed by filter 32 with a time constant which may be equivalent to the display time of several pictures, i.e. generally more than 10 ms, so as to obtain a substantially constant high D.C. biasing voltage Vb.

The amplifier 48 of the feedback block 39 receives a monitoring voltage Vm substantially proportional to the biasing voltage Vb, and regulates the supply current Is so that voltage Vm remains equal to the reference voltage Vref. This keeps the supply voltage Vs substantially constant, whereby the current maximum in coil 8 and the biasing voltage Vb remain substantially constant. The feedback block 39 performs as an integrator because of the capacitor 49.

The above control apparatus is known to be prone to a problem often referred to as "dynamic breathing" of the screen. The dynamic breathing corresponds to a variation of the length of lines of the screen when a sharp change of the brightness of an image being displayed on the screen occurs.

A need exists for a control apparatus that provides for the functionalities of the above control apparatus while suppressing the dynamic breathing of the screen.

SUMMARY OF THE INVENTION

A contribution of the inventor has been to identify the causes of the dynamic breathing. Displaying a bright area below a dark area on the screen results in significant extra power being drawn by the display from the secondary coil of the transformer. This significant extra power is not compensated immediately by the feedback block since the feedback loop has a response delay, whereby the extra power is immediately drawn from the primary coil of the transformer, which reduces the power supplied to the horizontal deviation yoke and reduces the width of the lines displayed. Similarly, displaying a dark area below a bright area results in increasing the width of the lines displayed. In a known manner, the change in the power drawn by the display follows a change of the current flowing through the cathode of the display. It is only after a while that the power supply will provide the new power level required by the displayed image, thus restoring the normal line width.

An aspect of the invention is that a measure of the cathode current is used to generate a compensation voltage that is added in a regular feedback loop.

Accordingly, the present invention relates to a control circuit of a power supply delivering a supply current to an inductor connected in series with the horizontal deflection yoke of a CRT display for displaying pictures comprised of successive lines, said inductor also being the primary coil of a low/high transformer operatively connected for delivering a rectified low-pass filtered biasing voltage to the anode of the display, said low-pass filtering having a first time constant corresponding to the display time of a plurality of pictures.

In particular, said control circuit comprises a feedback block generating a monitoring voltage substantially proportional to the biasing voltage of the anode and controlling the supply current so as to keep the monitoring voltage equal to a reference voltage; and a feedforward block for measuring the cathode current supplied to the cathode of the display tube and for adding to the monitoring voltage a compensation voltage corresponding to the cathode current, low-pass filtered with a second time constant corresponding to the display time of a small number of lines and high-pass filtered with said first time constant.

BRIEF DESCRIPTION OF THE DRAWINGS

The features and advantages of the present invention can be more readily understood with reference to the following description and appended claims when taken in conjunction with the accompanying drawings wherein:

DETAILED DESCRIPTION

Figure 1:
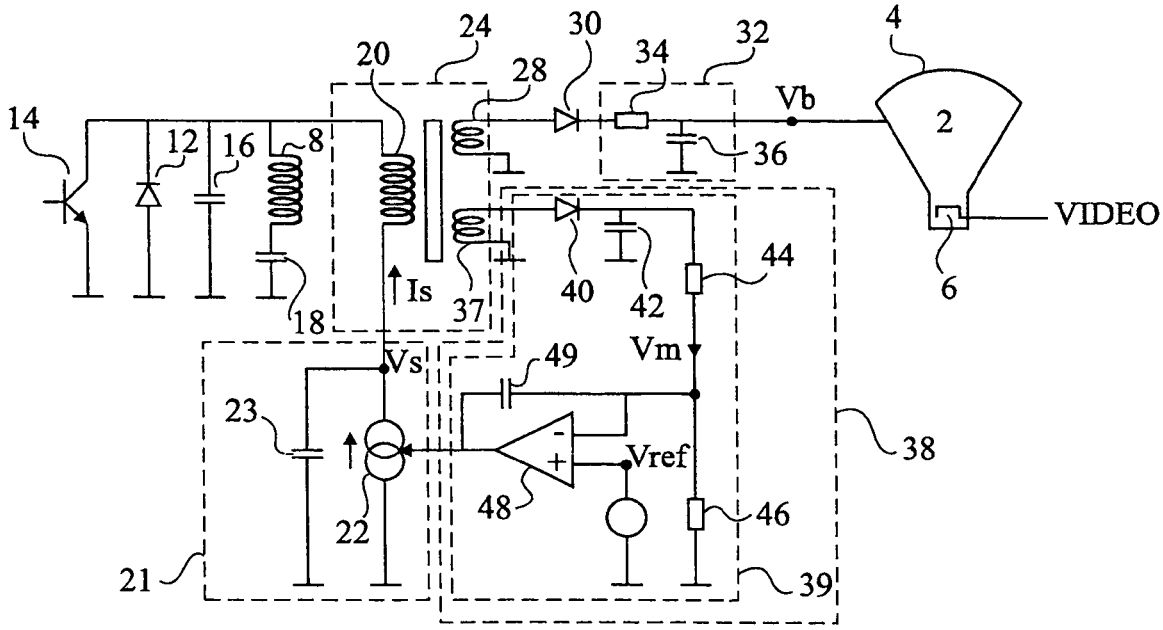
FIG. 1 is a schematic view of a prior art display control apparatus.
Figure 2:
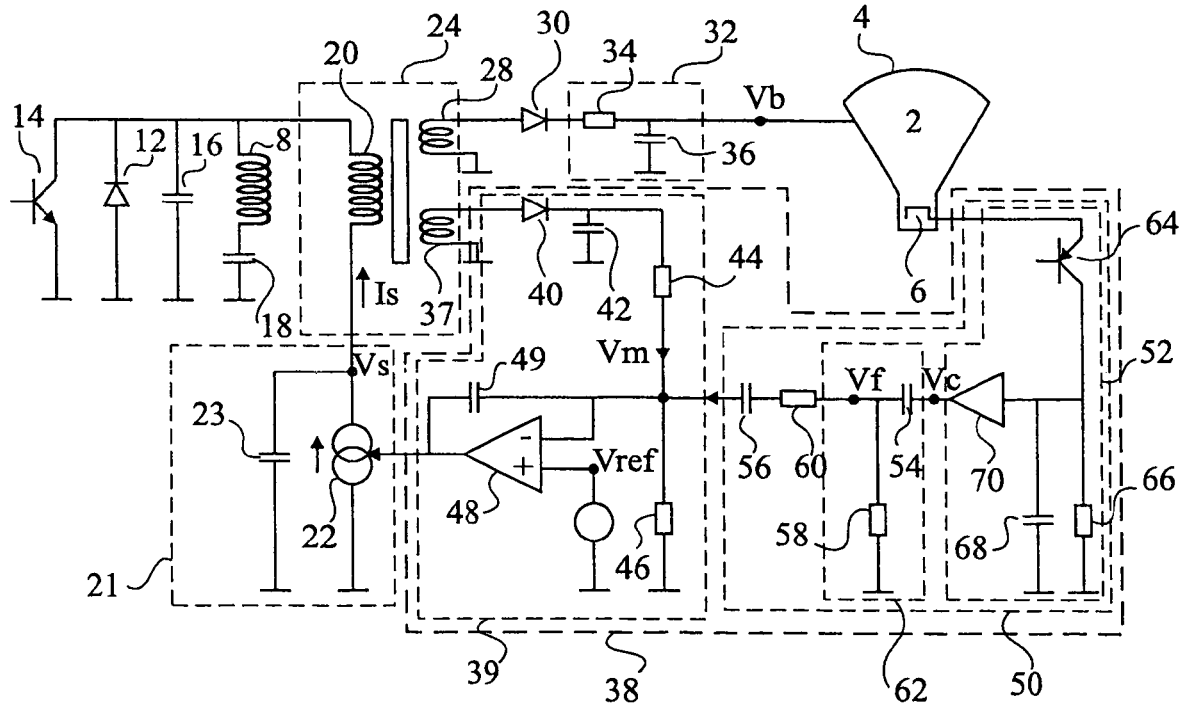
FIG. 2 is a schematic view of a first embodiment of a display control apparatus in accordance with the present invention.

FIG. 2 illustrates a schematic view of a first embodiment of an exemplary control apparatus according to the present invention of a CRT display 2 having an anode 4 and a cathode 6. The same reference numbers designate the same elements in FIG. 1 and 2. Only the elements that are necessary to the understanding of the invention have been illustrated. The control apparatus is generally comprised of a horizontal yoke control unit, an anode biasing unit, a power supply 21 and a control circuit 38 comprising a feedback block 39 operatively connected as described in relation with FIG. 1.

According to the invention, the control circuit 38 comprises, in addition to the elements disclosed in connection with FIG. 1, a feedforward block 50 comprising a measuring unit 52, capacitors 54 and 56, and resistors 58 and 60. Measuring unit 52 senses the cathode current of the CRT, and provides a corresponding voltage Vc. Voltage Vc is supplied to a first end of capacitor 54. The second end of capacitor 54 is connected through resistor 58 to the ground. Capacitor 54 and resistor 58 form a high-pass filter 62. The second end of capacitor 54, corresponding to the output of filter 62 is connected, through resistor 60 and coupling capacitor 56 in series, to the inverting input of amplifier 48.

According to a first embodiment of the invention, unit 52 is comprised of a driving transistor 64 having its emitter connected to the cathode 6, its collector connected to the ground through a sensing resistor 66, and its base operatively connected to receive a video signal. A capacitor 68 is connected in parallel with resistor 66. A buffer 70 is preferably connected between the collector of transistor 64 and the output of unit 52.

The buffer 70 of the feedforward block delivers to filter 62 a voltage Vc corresponding to the cathode current flowing through resistor 66, filtered by the parallel connection of resistor 66 and capacitor 68. Preferably, the low-pass filter 66–68 is chosen to introduce a time constant of a few lines, i.e. 0.1 ms, so as to smooth the cathode signal.

In filter 62, capacitor 54 and resistor 58 are chosen so as to filter the voltage signal Vc provided by buffer 70 with a time constant RC substantially equal to the time constant of filter 32 so as not to take into account slow variations of the smoothed cathode signal and to give the filtered voltage an appropriate time constant, as explained below. The voltage supplied by filter 62 through the coupling capacitor is integrated by the amplifier 48, configured as an integrator by capacitor 49. Resistor 60 provides for tuning the compensation voltage.

The successive display of a dark zone and a bright zone on the screen corresponds to a step increase of the cathode current supplied to cathode 6, which corresponds to a step increase ΔV of the voltage across resistor 66. In response to the step increase ΔV, filter 62 delivers a filtered compensation voltage $Vf=\Delta V.e^{(-t/RC)}$, which after integration gives a correction voltage Vcor proportional to $\Delta V.RC.(1-e^{(-t/RC)})$. The inventor has shown that such a correction voltage, added to the usual control voltage provided by the feedback block, compensates the step increase of the cathode current. A reciprocal correction is caused when a dark zone is displayed after a bright zone on the screen.

Figure 3:
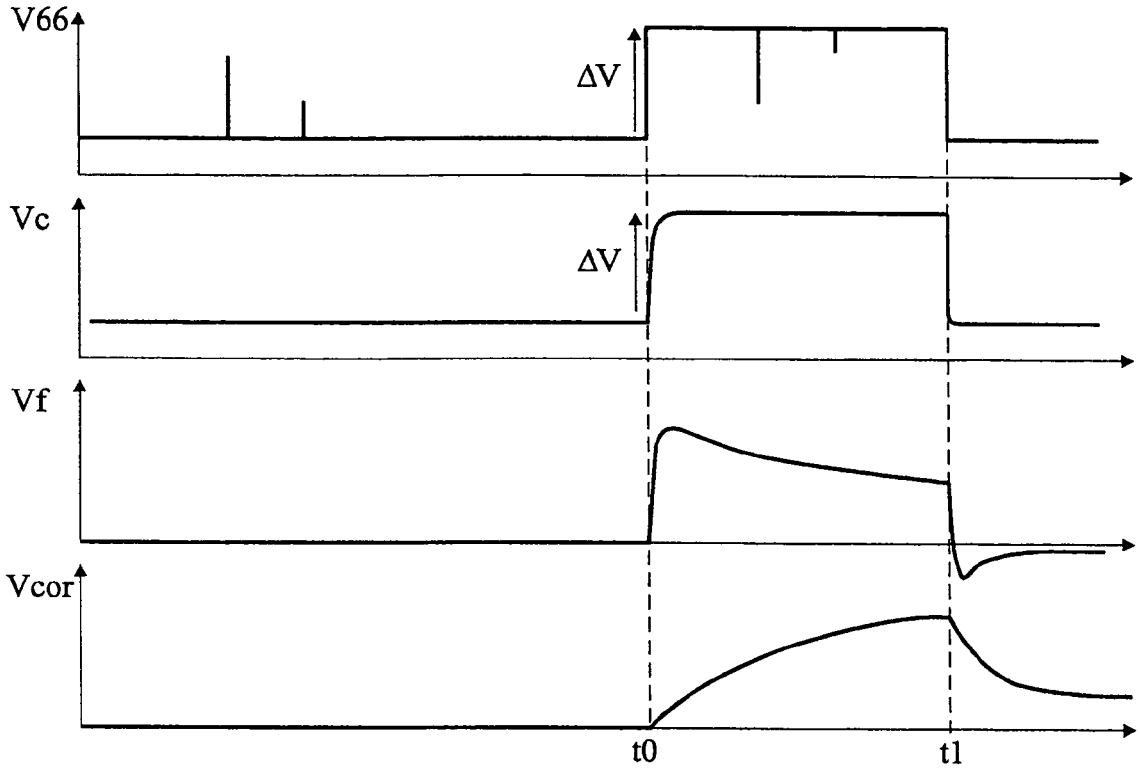
FIG. 3 illustrates an exemplary operation of the display control apparatus illustrated in FIG. 2.

FIG. 3 illustrates exemplary variations of voltage V66 across resistor 66, and of the corresponding voltage Vc supplied by buffer 70, filtered voltage Vf and correction voltage Vcor, during an exemplary operation of the display of FIG. 2. The shape of the curves is only intended to be illustrative.

Initially, voltage V66 corresponds to the display of a dark picture and remains at a low value, while comprising voltage peaks shorter than the display time of a small number of lines. The variations of voltage Vc corresponds to the variations of current Icat, smoothed by filter 66, 68. As long as Vc is constant, Vf remains null. The variations of voltage Vc, slow, are suppressed by filter 62 and voltage Vf is constant. Correction voltage Vcor is constant.

At a time to, voltage V66 follows a step increase ΔV corresponding to the display of a plurality of bright lines. Since the step increase lasts longer than a small number of lines, voltage Vc follows a same step increase ΔV. The influence of filter 66, 68 is hardly visible at this scale. As described above, in response to step increase ΔV of voltage Vc, filter 62 delivers filtered voltage $Vf=\Delta V.e^{(-t/RC)}$ and integrator 48 delivers, in addition to the usual control voltage provided by the feedback block, the correction voltage Vcor proportional to $\Delta V.RC.(1-e^{(-t/RC)})$.

At a time t1 is illustrated a reciprocal correction corresponding to a step reduction of voltage V66, when a dark zone is displayed above a bright zone.

Due to the control circuit according to the invention, the transformer delivers to the horizontal deviation yoke of the display a substantially constant power through its primary coil, while the power delivered to the biasing unit follows the variations of the cathode current, thereby eliminating dynamic breathing.

Figure 4:
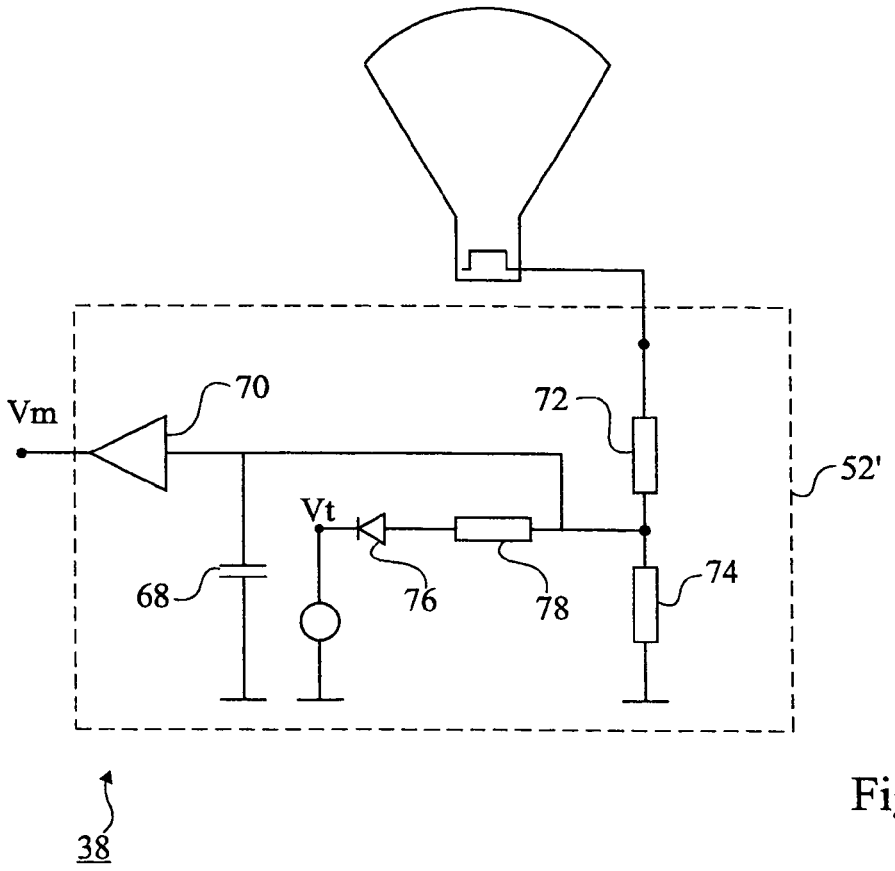
FIG. 4 is a partial, schematic view of a feedforward block in accordance with a preferred embodiment of the present invention.

FIG. 4 illustrates a partial schematic view of a unit 52' replacing, in a preferred embodiment of the invention, the unit 52 illustrated in FIG. 2 of the control circuit 38. In some display structures, it may only be possible to sense the cathode voltage and the cathode voltage is known to correspond in a non linear way to the cathode current. The inventor has considered that the cathode voltage can be converted to provide a measure of the cathode current: for instance, in a very simple implementation, it can be approximated as being proportional to the cathode current along a first slope when the cathode voltage is smaller than a predetermined voltage, and along a second slope when the cathode voltage is greater than the predetermined voltage.

Accordingly, unit 52' comprises a voltage divider, comprised of two resistors 72, 74 connected in series between the cathode 6 of the display 2 and the ground. The output of the voltage divider is connected through a filter capacitor 68 to the ground and through a buffer 70 to the output of unit 52'. In addition, the output of the voltage divider is connected to the anode of a diode 76 through a resistor 78. The cathode of diode 76 is connected to a predetermined threshold voltage Vt.

As long as the cathode voltage is smaller than a predetermined voltage depending on the dividing ratio of the voltage divider and of threshold voltage source Vt, voltage Vc delivered by unit 52' follows the variations of the cathode voltage along a first slope depending on the dividing ratio of the voltage divider.

When the cathode voltage is greater than the predetermined voltage, voltage Vc follows the variations of the cathode voltage along a second slope depending on the dividing ratio of the voltage divider modified by the parallel connection of resistor 78.

In the exemplary embodiments, the display as illustrated has a general configuration of a monochrome display with only one cathode. Those skilled in the art, however, will appreciate that the number of cathode may vary without departing from the spirit of the present invention and that the words "cathode current" must in that case be understood as actually designating the sum of the currents flowing through each of the cathodes of the display.

In the case of a color monitor (not illustrated) comprising two additional cathodes, the unit 52' of FIG. 3 will comprise two additional resistors (not illustrated) having the same value as resistor 72, each connected between one of said additional cathodes and the node between resistors 72 and 74.

Also, in view of the above, one skilled in the art will easily adapt the structure of the unit 52 of FIG. 2 to the case of a colour monitor.

For clarity's sake, unit 52' has been illustrated as being connected directly to cathode 6. Actually, the video unit (not illustrated) driving cathode 6 is often connected to the cathode 6 through a clamping unit comprising a series capacitor, in which case unit 52' will preferably be connected to the output of the video unit and receive only the variations of the cathode voltage due to the video signal.

Those skilled in the art will also appreciate that there may be other ways of designing or combining the feedback block or the feedforward block of the control circuit, including modifications and combinations of the means described herein. As an example, the capacitor 56 of unit 50 may be eliminated by biasing the voltage Vc to a voltage level appropriate not to shift the D.C. level of the input of amplifier 48. Thus, while certain representative embodiments and details have been shown for purposes of illustrating the invention, it will be apparent to those skilled in the art that various changes in the invention disclosed herein may be made without departing from the scope of the invention, which is defined in the appended claims.

What is claimed is:

1. A control circuit of a power supply delivering a supply current to an inductor connected in series with a horizontal deflection yoke of a cathode ray tube display for displaying pictures comprised of successive lines, said inductor being the primary coil of a low/high transformer operatively connected for delivering a rectified low-pass filtered biasing voltage to the anode of the display, said low-pass filtering having a first time constant corresponding to the duration of a small number of pictures, said control circuit comprising:

feedback means for generating a monitoring voltage substantially proportional to said biasing voltage and for controlling said supply current so as to keep said monitoring voltage equal to a reference voltage; and feedforward means for measuring the cathode current supplied to the cathode of the display and for adding to said monitoring voltage a compensation voltage corresponding to said cathode current, low-pass filtered with a second time constant corresponding to the duration of a small number of lines and high-pass filtered with said first time constant.

2. A control circuit according to claim 1, wherein said monitoring voltage is provided by a sensing coil of the transformer, operatively connected through a rectifier diode and a first voltage divider to an integrator, the output of said integrator supplying an output control signal of the control circuit.

3. A control circuit according to claim 2, wherein the input and output of said integrator are respectively the inverting input and output of an operational amplifier, connected through a capacitor, the non inverting input of the operational amplifier receiving said reference voltage.

4. A control circuit according to claim 3, wherein said feedforward means comprise at least a second voltage divider provided for receiving the variations of the cathode voltage, the output of said second voltage divider being connected through a resistor to the anode of a diode, the cathode of said diode being connected to a predetermined threshold voltage; and the output of said second voltage divider being operatively connected through a capacitor to the input of said integrator.

5. A CRT display, the control apparatus of which comprises a control circuit according to claim 1.

6. A control apparatus of a cathode ray tube display for displaying pictures comprised of successive lines, comprising:

power supply means provided for supplying a supply current to an inductor connected in series with a horizontal deflection yoke of the display;

biasing means comprising a low/high transformer, the primary coil of said transformer being said inductor, for delivering a rectified low-pass filtered biasing voltage to the anode of the display, said low-pass filtering having a first time constant corresponding to the duration of a plurality of pictures;

feedback means for generating a monitoring voltage substantially proportional to said biasing voltage and for controlling said supply current so as to keep said monitoring voltage equal to a reference voltage; and feedforward means for measuring the cathode current supplied to the cathode of the display and for adding to said monitoring voltage a compensation voltage corresponding to said cathode current, low-pass filtered with a second time constant corresponding to the duration of a small number of lines and high-pass filtered with said first time constant.

7. A control apparatus according to claim 6, wherein said monitoring voltage is provided by a sensing coil of the transformer, operatively connected through a rectifier diode and a first voltage divider to an integrator, the output of said integrator supplying an output control signal of the control circuit.

8. A control apparatus according to claim 7, wherein the input and output of said integrator are respectively the inverting input and output of an operational amplifier, connected through a capacitor, the non inverting input of the operational amplifier receiving said reference voltage.

9. A control apparatus according to claim 8, wherein said feedforward means comprises at least a second voltage divider provided for receiving the variations of the cathode voltage, the output of said second voltage divider being connected through a resistor to the anode of a diode, the cathode of said diode being connected to a predetermined threshold voltage; and the output of said second voltage divider being operatively connected through a capacitor to the input of said integrator.

10. A CRT display comprising a control apparatus according to claim 6.

11. A control process of a power supply provided for delivering a supply current to an inductor connected in series with a horizontal deflection yoke of a cathode ray tube display for displaying pictures comprised of successive lines, said inductor being the primary coil of a low/high transformer operatively connected for delivering a rectified low-pass filtered biasing voltage to the anode of the display, said low-pass filtering having a first time constant corresponding to the duration of a plurality of pictures, said control circuit comprising the following steps:

generating a monitoring voltage substantially proportional to said biasing voltage and controlling said supply current so as to keep said monitoring voltage equal to a reference voltage; and measuring the cathode current supplied to the cathode of the display and adding to said monitoring voltage a compensation voltage corresponding to said cathode current, low-pass filtered with a second time constant corresponding to the duration of a small number of lines and high-pass filtered with said first time constant.

12. A control circuit of a power supply that delivers a supply current to an inductor of a cathode ray tube display, said inductor being a primary coil of a low/high transformer operatively connected to deliver a rectified low-pass filtered biasing voltage to an anode of the display, said low-pass filtering having a first time constant corresponding to a duration of a small number of pictures, said control circuit comprising:

feedback circuitry constructed and arranged to generate a monitoring voltage substantially proportional to said biasing voltage and for controlling said supply current so as to keep said monitoring voltage equal to a reference voltage; and feedforward circuitry constructed and arranged to measure a cathode current supplied to a cathode of the cathode ray tube display and for adding to said monitoring voltage a compensation voltage corresponding to said cathode current, low-pass filtered with a second time constant corresponding to the duration of a small number of lines and high-pass filtered with said first time constant.

13. A control circuit according to claim 12, wherein said monitoring voltage is provided by a sensing coil of the transformer, operatively connected through a rectifier diode and a first voltage divider to an integrator, the output of said integrator supplying an output control signal of the control circuit.

14. A control circuit according to claim 13, wherein the input and output of said integrator are respectively the inverting input and output of an operational amplifier, connected through a capacitor, the non inverting input of the operational amplifier receiving said reference voltage.

15. A control circuit according to claim 14, wherein said feedforward means comprise at least a second voltage divider provided for receiving the variations of the cathode voltage, the output of said second voltage divider being connected through a resistor to the anode of a diode, the cathode of said diode being connected to a predetermined threshold voltage; and the output of said second voltage divider being operatively connected through a capacitor to the input of said integrator.

16. A CRT display, the control apparatus of which comprises a control circuit according to claim 12.

17. A control apparatus of a cathode ray tube display for displaying pictures comprised of successive lines, comprising:

a power supply that supplies a supply current to an inductor coupled to a horizontal deflection yoke of the display;

a biasing circuit comprising a low/high transformer, a primary coil of said transformer being said inductor, for delivering a rectified low-pass filtered biasing voltage to an anode of the display, said low-pass filtering having a first time constant corresponding to a duration of a plurality of pictures;

feedback circuitry constructed and arranged to generate a monitoring voltage substantially proportional to said biasing voltage and for controlling said supply current so as to keep said monitoring voltage equal to a reference voltage; and feedforward circuitry constructed and arranged to measure a cathode current supplied to a cathode of the cathode ray tube display and for adding to said monitoring voltage a compensation voltage corresponding to said cathode current, low-pass filtered with a second time constant corresponding to the duration of a small number of lines and high-pass filtered with said first time constant.

18. A control apparatus according to claim 17, wherein said monitoring voltage is provided by a sensing coil of the transformer, operatively connected through a rectifier diode and a first voltage divider to an integrator, the output of said integrator supplying an output control signal of the control circuit.

19. A control apparatus according to claim 18, wherein the input and output of said integrator are respectively the inverting input and output of an operational amplifier, connected through a capacitor, the non inverting input of the operational amplifier receiving said reference voltage.

20. A control apparatus according to claim 19, wherein said feedforward means comprises at least a second voltage divider provided for receiving the variations of the cathode voltage, the output of said second voltage divider being connected through a resistor to the anode of a diode, the cathode of said diode being connected to a predetermined threshold voltage; and the output of said second voltage divider being operatively connected through a capacitor to the input of said integrator.

21. A CRT display comprising a control apparatus according to claim 17.

22. A method for delivering a supply current to an inductor of a cathode ray tube display, said inductor being a primary coil of a low/high transformer operatively connected to deliver a rectified low-pass filtered biasing voltage to an anode of the display, said low-pass filtering having a first time constant corresponding to a duration of a plurality of pictures, comprising:

generating a monitoring voltage substantially proportional to said biasing voltage and controlling said supply current so as to keep said monitoring voltage equal to a reference voltage; and measuring a cathode current supplied to the cathode of the display and adding to said monitoring voltage a compensation voltage corresponding to said cathode current, low-pass filtered with a second time constant corresponding to the duration of a small number of lines and high-pass filtered with said first time constant.

* * * * *

UNITED STATES PATENT AND TRADEMARK OFFICE

CERTIFICATE OF CORRECTION

PATENT NO. : 7,248,233 B2
APPLICATION NO. : 10/701151
DATED : July 24, 2007
INVENTOR(S) : Jean-Michel Moreau It is certified that error appears in the above-identified patent and that said Letters Patent is hereby corrected as shown below:

On the title page, item (30) should read:
Jul. 1, 2003 (EP) .....03300045

Col. 4, line 48 should read:

At a time t0, voltage V66 follows a step increase $\Delta V$

Signed and Sealed this

Eighteenth Day of September, 2007

JON W. DUDAS
*Director of the United States Patent and Trademark Office*